US007326074B1

(12) United States Patent
Lim et al.

(10) Patent No.: US 7,326,074 B1
(45) Date of Patent: Feb. 5, 2008

(54) CONNECTOR POSITION ASSURANCE DEVICE AND A CONNECTOR ASSEMBLY INCORPORATING THE CONNECTOR POSITION ASSURANCE DEVICE

(75) Inventors: Eng Chuan Lim, Singapore (SG); Ping Chen, West Bloomfield, MI (US)

(73) Assignee: J.S.T. Corporation, Farmington Hills, MI (US)

( * ) Notice: Subject to any disclaimer, the term of this patent is extended or adjusted under 35 U.S.C. 154(b) by 0 days.

(21) Appl. No.: 11/634,213

(22) Filed: Dec. 6, 2006

(51) Int. Cl.
*H01R 13/514* (2006.01)

(52) U.S. Cl. ..... 439/352

(58) Field of Classification Search ..... 439/356, 439/595, 752, 352
See application file for complete search history.

(56) References Cited

U.S. PATENT DOCUMENTS

| | | | | |
|---|---|---|---|---|
| 5,775,930 | A | 7/1998 | Model et al. | |
| 6,068,507 | A * | 5/2000 | Popa | 439/489 |
| 6,077,101 | A | 6/2000 | Garretson et al. | |
| 6,234,826 | B1 * | 5/2001 | Wilber et al. | 439/352 |
| 6,250,947 | B1 * | 6/2001 | Holzer | 439/379 |
| 6,261,116 | B1 | 7/2001 | Ceru | |
| 6,435,895 | B1 * | 8/2002 | Fink et al. | 439/352 |
| 6,491,542 | B1 | 12/2002 | Zerebilov | |
| 6,743,051 | B2 * | 6/2004 | Hayashi | 439/620.05 |
| 6,780,045 | B2 * | 8/2004 | Shuey et al. | 439/489 |
| 6,893,277 | B2 * | 5/2005 | Parrish et al. | 439/188 |
| 2001/0002758 | A1 | 6/2001 | Hanser et al. | |

FOREIGN PATENT DOCUMENTS

| | | |
|---|---|---|
| JP | 2537302 | 7/1996 |

* cited by examiner

*Primary Examiner*—Neil Abrams
*Assistant Examiner*—Harshad C Patel
(74) *Attorney, Agent, or Firm*—Rader, Fishman & Grauer PLLC; Carl Schaukowitch

(57) ABSTRACT

A connector position assurance device includes a pair of locking arm members, a cross member and a pair of guide elements. The pair of locking arm members is disposed apart from one another in a generally parallel manner. Each locking arm member has an outwardly-facing side surface, a rear end portion and a forward end portion. The forward end portion is integrally connected to and disposed opposite the rear end portion. Each forward end portion has a locking projection depending from the bottom surface. The cross member is integrally connected to the pair of locking arm members. Each guide element is integrally connected to and projects outwardly from a respective one of the outwardly-facing side surfaces at the rear end portions. A connector assembly that incorporates the connector position assurance device is also described.

34 Claims, 12 Drawing Sheets

CONNECTOR POSITION ASSURANCE DEVICE AND A CONNECTOR ASSEMBLY INCORPORATING THE CONNECTOR POSITION ASSURANCE DEVICE

FIELD OF THE INVENTION

The present invention relates to a connector position assurance device and a connector position assurance device that is adapted for use with a connector assembly.

BACKGROUND OF THE INVENTION

Connector position assurance devices are commonly known in the art. One such example is described in U.S. Pat. No. 6,077,101 to Garretson et al. Garretson teaches an electrical connector that includes a first connector body, a second connector body and a connector position assurance device. The first connector body has a lock ramp. The second connector body mates with the first connector body and has a lock arm that engages the lock ramp of the first connector body to lock the first and second connector bodies together when the first and second connector bodies are mated. The connector position assurance device is slidably retained on the connector body for assuring that the first and second connector bodies are properly mated and locked together. The connector position assurance device has a top wall and depending side walls at respective longitudinal edges of the top wall. The top wall has a depending pusher portion at one end for pushing the lock arm into engagement with the lock ramp. And, the connector position assurance device has a target portion at the opposite end of the top wall for applying a force to the connector position assurance device.

As demonstrated by way of example only in Garretson, the conventional connector position assurance devices use the top wall that is stressed permanently when the connector position assurance device is engaged. Also, by way of example only in Garretson, the top wall is used as a lever for releasing the conventional connector position assurance device. This results in a loss of feeling by the user in releasing the conventional position assurance device.

It would be beneficial to provide a connector position assurance device that is not permanently stressed when engaged with a connector assembly. It would also be beneficial to provide a connector position assurance device that has a lever that can be directly depressed by a user to release the connector position assurance device. The present invention provides these benefits.

OBJECTS AND SUMMARY OF THE INVENTION

It is an object of the invention to provide a connector position assurance device that is not permanently stressed when engaged with a connector assembly.

It is another object of the invention to provide a connector position assurance device that has a lever that can be directly depressed by a user to release the connector position assurance device from engagement with the connector assembly.

A connector position assurance device of the present invention is hereinafter described. The connector position assurance device includes a pair of locking arm members, a cross member and a pair of guide elements. The pair of locking arm members is disposed apart from one another in a generally parallel manner. Each locking arm member has a top surface, a bottom surface, an outwardly-facing side surface extending between the top and bottom surfaces, a rear end portion and a forward end portion. The forward end portion is integrally connected to and disposed opposite the rear end portion. Each forward end portion has a locking projection depending from the bottom surface. The cross member is integrally connected to the pair of locking arm members on the respective top surfaces at the rear end portions. Each guide element is integrally connected to and projects outwardly from a respective one of the outwardly-facing side surfaces at the rear end portions.

Also, a connector assembly that incorporates the connector position assurance device is also hereinafter described.

These objects and other advantages of the present invention will be better appreciated in view of the detailed description of the exemplary embodiments of the present invention with reference to the accompanying drawings, in which:

DETAILED DESCRIPTION OF THE EXEMPLARY EMBODIMENTS

Figure 1:
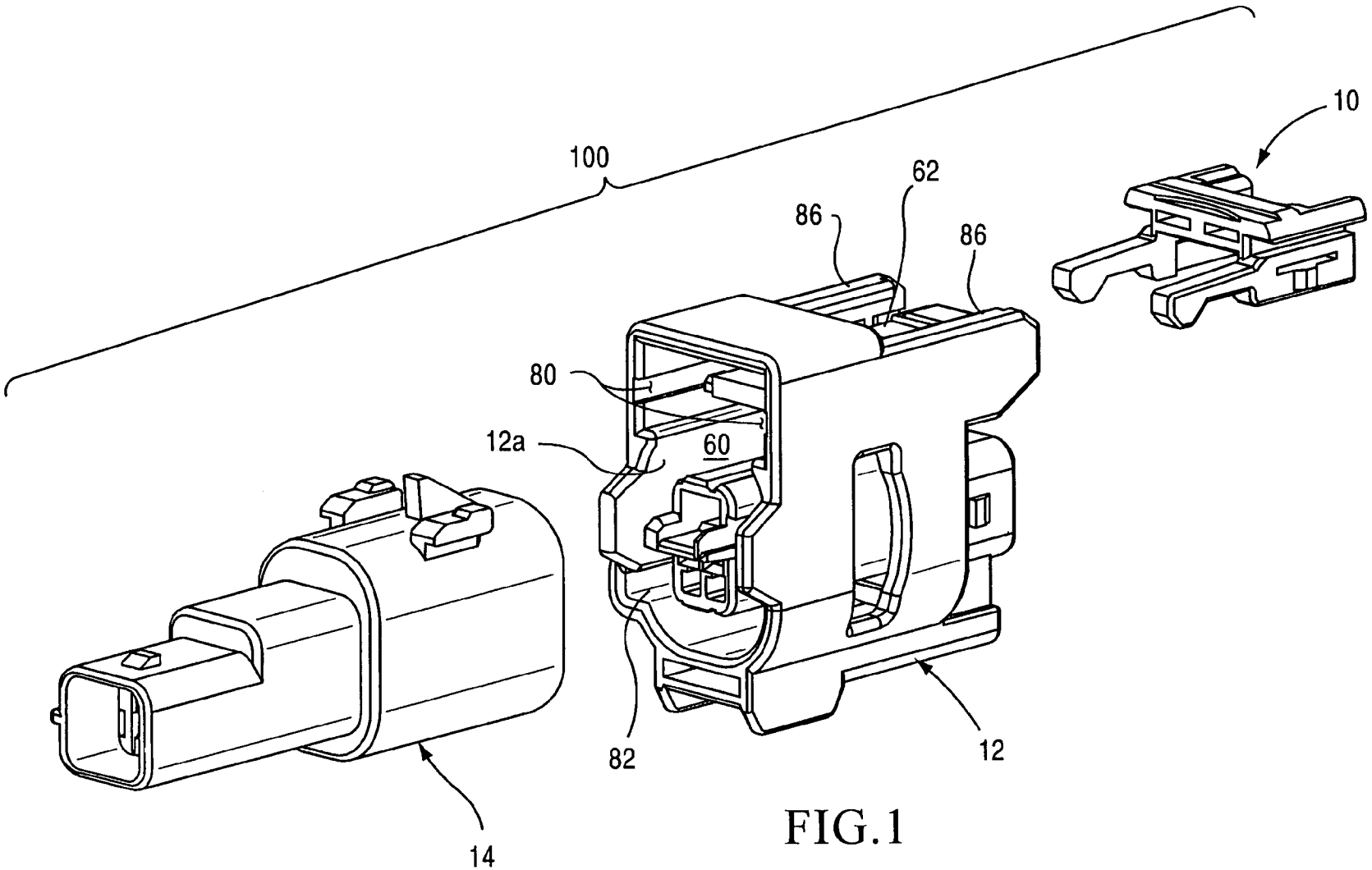
FIG. 1 is an exploded perspective view of one exemplary embodiment of a connector assembly of the present invention that includes another exemplary embodiment of a connector position assurance device of the present invention, a first connector member and a second connector member.
Figure 2:
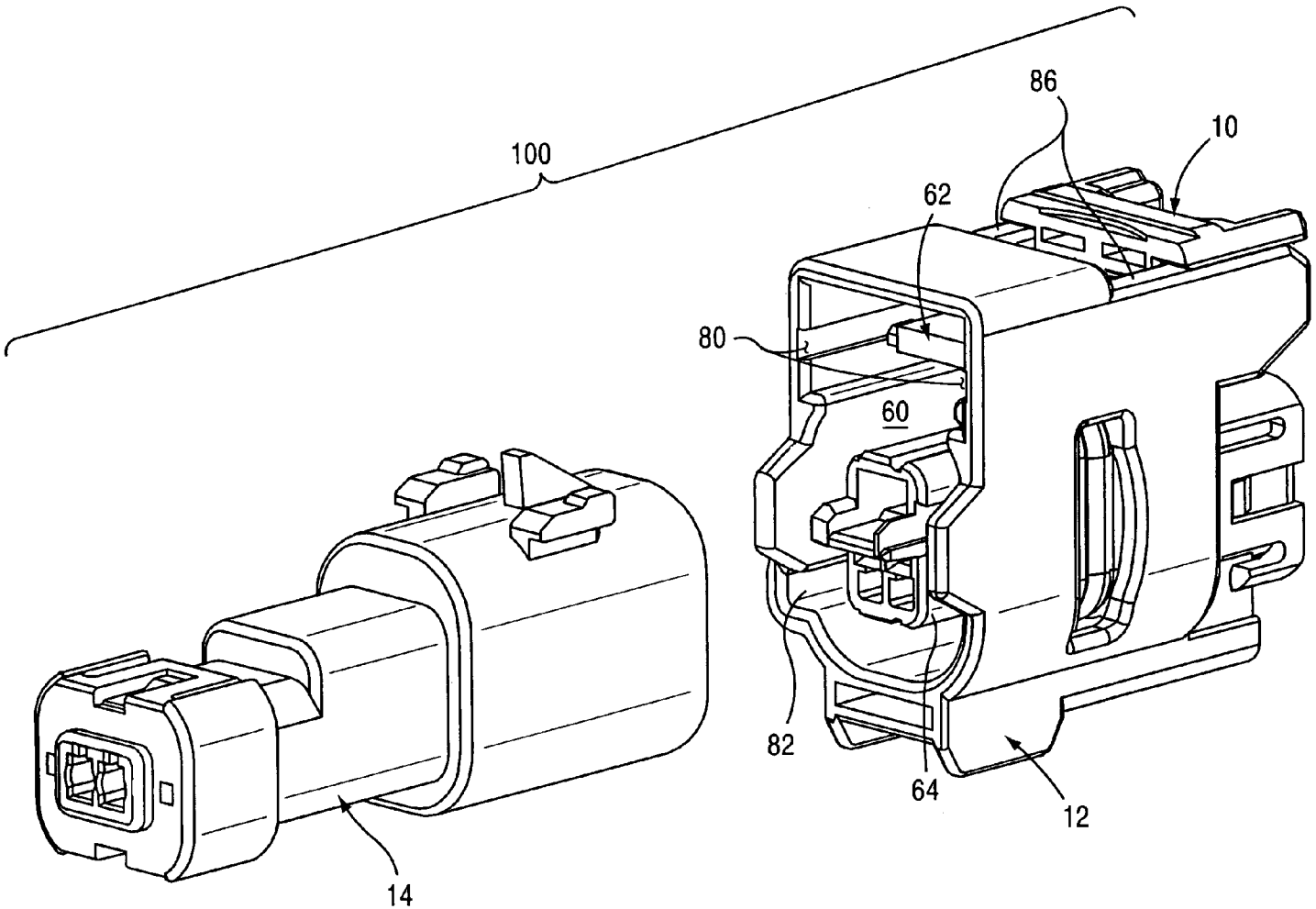
FIG. 2 is an exploded perspective view as shown in FIG. 1 with the connector position assurance device in a disengaged position and slidably connected to the first connector member.

An exemplary embodiment of a connector position assurance device 10 of the present invention is hereinafter described with reference to FIGS. 1-6. As shown in FIGS. 1 and 2, the connector position assurance device 10 is illustrated in combination with a first connector member 12 and a second connector member 14 to form a connector assembly 100 of the present invention. The connector assembly 100 of the present invention is discussed below in further detail.

Figure 3:
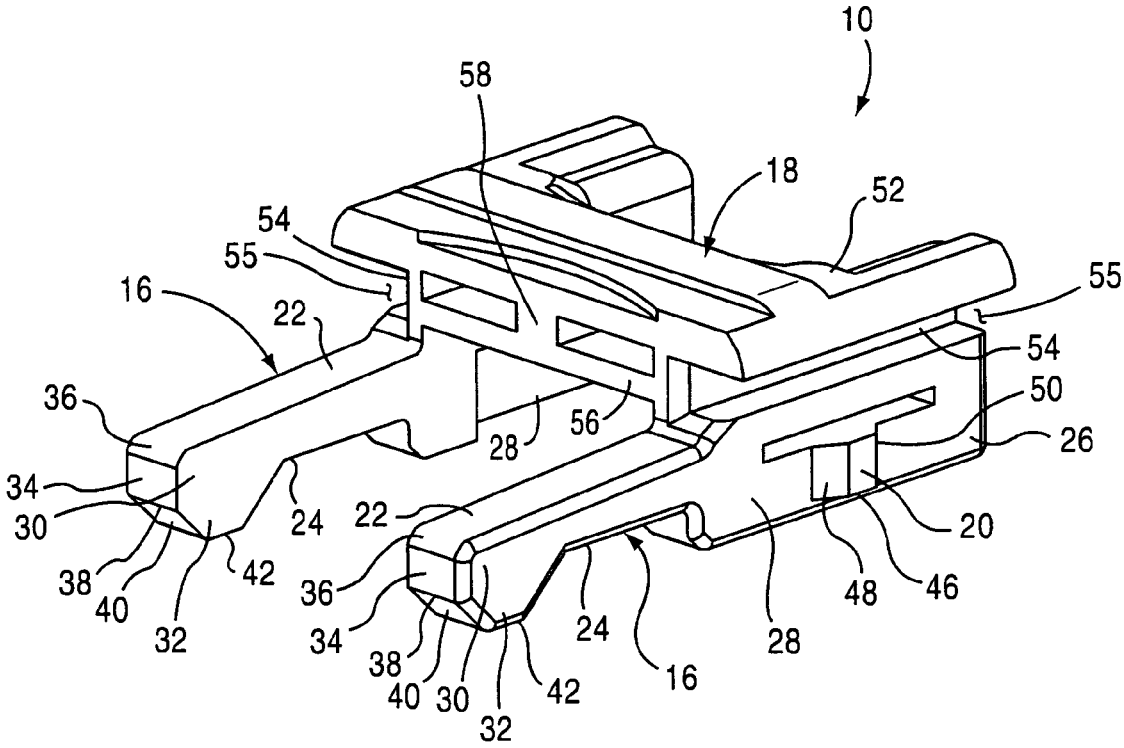
FIG. 3 is a perspective view of the connector position assurance device of the present invention.
Figure 4:
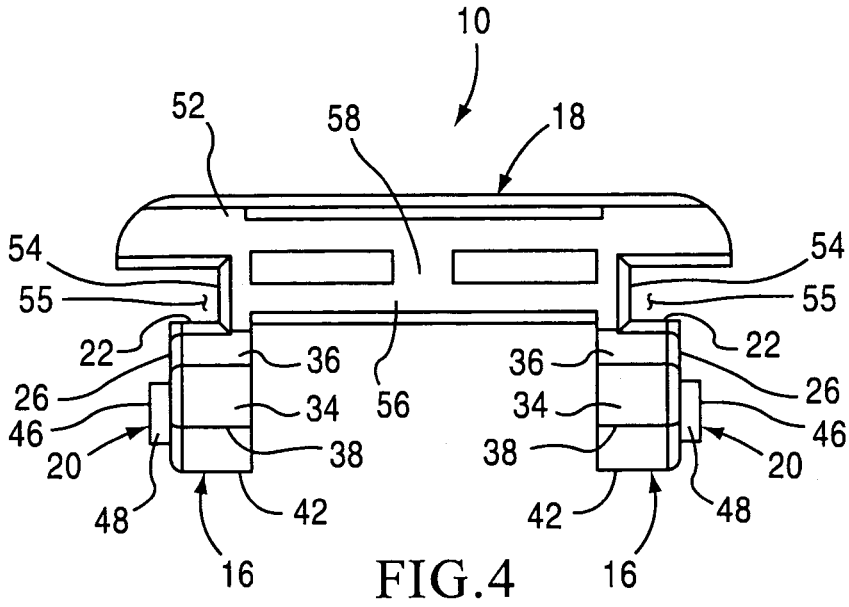
FIG. 4 is a front elevational view shown on the connector position assurance device of the present invention.
Figure 5:
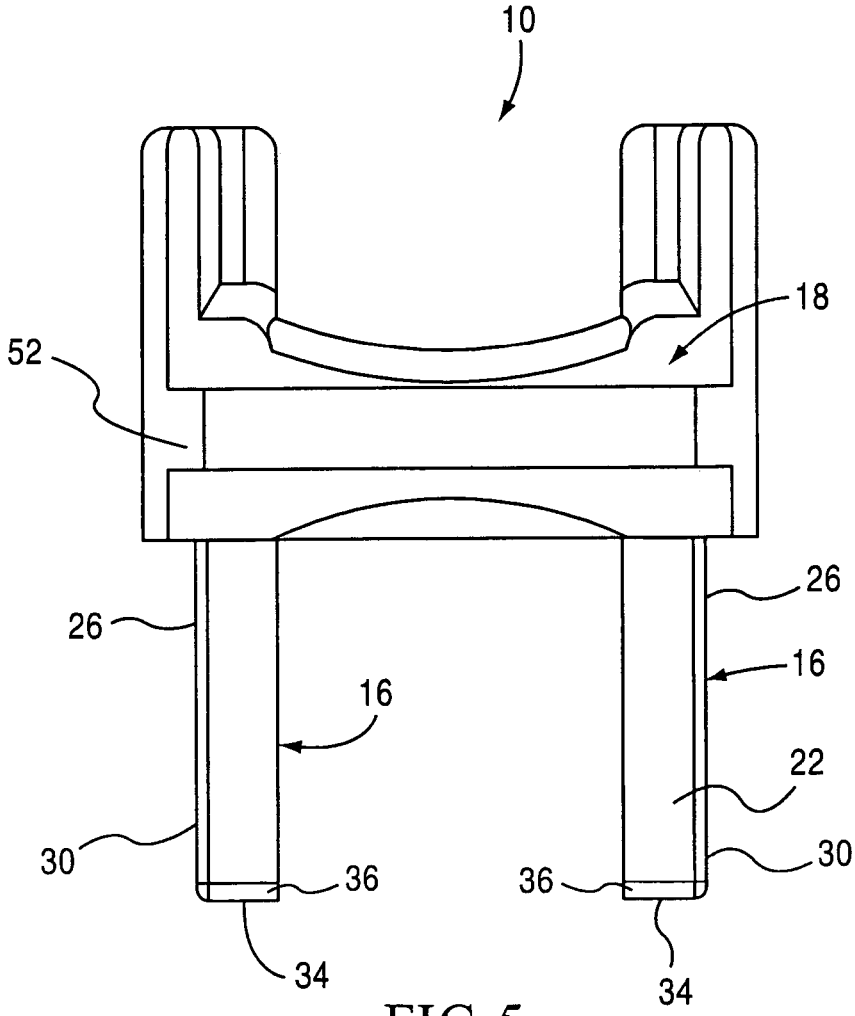
FIG. 5 is a top planar view of the connector position assurance device of the present invention.

With reference to FIGS. 3-6, the connector position assurance device 10 includes a pair of locking arm members 16, a cross member 18 and a pair of guide elements 20. The pair of locking arm members 16 is disposed apart from one another in a generally parallel manner as best shown in FIGS. 3-5. Each locking arm member 16 has a top surface 22, a bottom surface 24, an outwardly-facing side surface 26 extending between the top surface 22 and the bottom surfaces 24, a rear end portion 28 and a forward end portion 30. The forward end portion 30 is integrally connected to and disposed opposite the rear end portion 28. Each forward end portion 30 has a locking projection 32 depending from the bottom surface 24. The cross member 18 is integrally connected to the pair of locking arm members 16 on the respective top surfaces 22 at the rear end portions 28. Each guide element 20 is integrally connected to and projects outwardly from a respective one of the outwardly-facing side surfaces 26 at the rear end portions 28.

Figure 6:
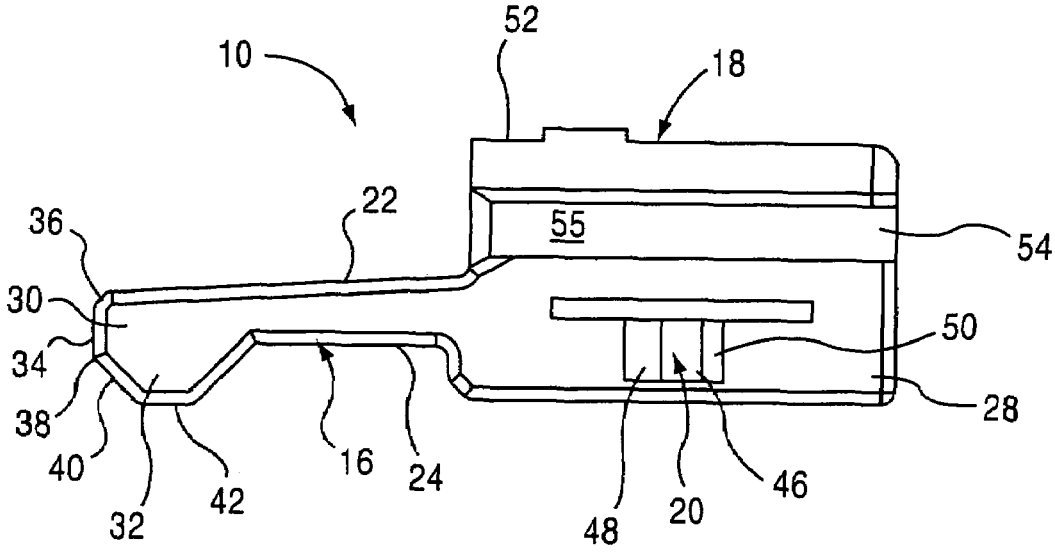
FIG. 6 is a side elevational view of the connector position assurance device of the present invention.

As best shown in FIGS. 3, 5 and 6, each forward end portion 30 has a generally flat front surface 34 extending between the top surface 22 and the locking projection 32. Further, each locking arm member 16 includes a top curved edge 36 interconnecting the top surface 22 and the generally flat front surface 34. Also, each locking arm member 16 includes a bottom curved edge 38 that interconnects the locking projection 32 and the generally flat front surface 34.

As best shown in FIGS. 3 and 6, each locking projection 32 is configured in a trapezoidal shape. Each locking projection 32 has a first tapered surface 40 that connects the bottom curved edge 38 and tapers downwardly and rearwardly from the bottom curved edge 38 towards the rear end portion 28. Each locking projection 32 also has a flat bottom locking projection surface 42 that extends generally parallel with the top surface 22. Additionally, each locking projection 32 has a second tapered surface 44 that connects the flat bottom locking projection surface 42 and tapers upwardly and rearwardly from the flat bottom locking projection surface 42 to the bottom surface 24 of the locking arm member 16.

As shown in FIGS. 3 and 6, respective ones of the forward end portions 30 are integrally formed with respective ones of the rear end portions 28 in a cantilevered manner.

As illustrated in FIGS. 3, 4 and 6, each one of the guide elements 20 has a guide element flat surface 46, a first guide element tapered surface 48 and a second guide element tapered surface 50. Each respective one of the first guide element tapered surfaces 48 tapers forwardly from the guide element flat surface 46 to the outwardly-facing side surface 26 of the rear end portion 28 and each respective one of the second guide tapered surfaces 50 tapers rearwardly from the guide element flat surface 46 to the outwardly-facing side surface 26 of the rear end portion 28.

With reference to Figures of 3-6, the cross member 18 includes a top panel 52 and a pair of side panels 54. Respective ones of the side panels 54 are disposed between and integrally connect the top panel 52 and the rear end portions 28 of the locking arm members 16 at the top surface 22 to define a pair of cross member guide channels 55. Each one of the cross member guide channels 55 extends parallel with the pair of locking arm members 16. Additionally, the cross member 18 includes a bottom panel 56 disposed apart from and extending parallel with the top panel 52 and between the pair of side panels 54. The bottom panel 56 is integrally connected to and between the pair of side panels 54. Furthermore, the cross member 18 includes a rib 58 that is disposed between and integrally connected to the top and bottom panels 52 and 56 respectively. Also, the rib 58 is disposed generally centrally between the pair of side panels 54 and extends parallel with the pair of locking arm members 16 as shown in FIG. 4. Also, as shown in FIGS. 3 and 4, the top panel 52 extends outwardly relative to the respective ones of the rear end portions 28 of the locking arm members 16 and extends outwardly relative to respective ones of the pair of guide elements 20.

Figure 7:
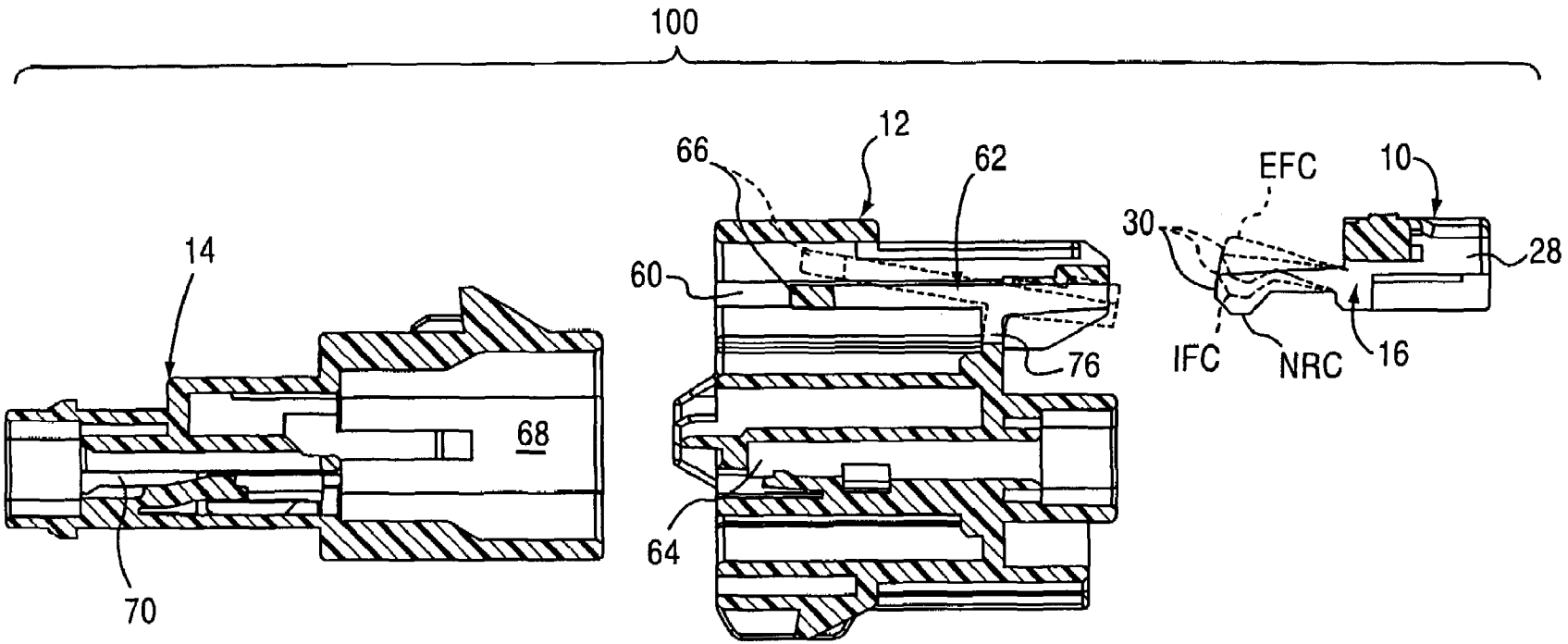
FIG. 7 is cross-sectional view of the connector assembly shown in FIG. 1.
Figure 8:
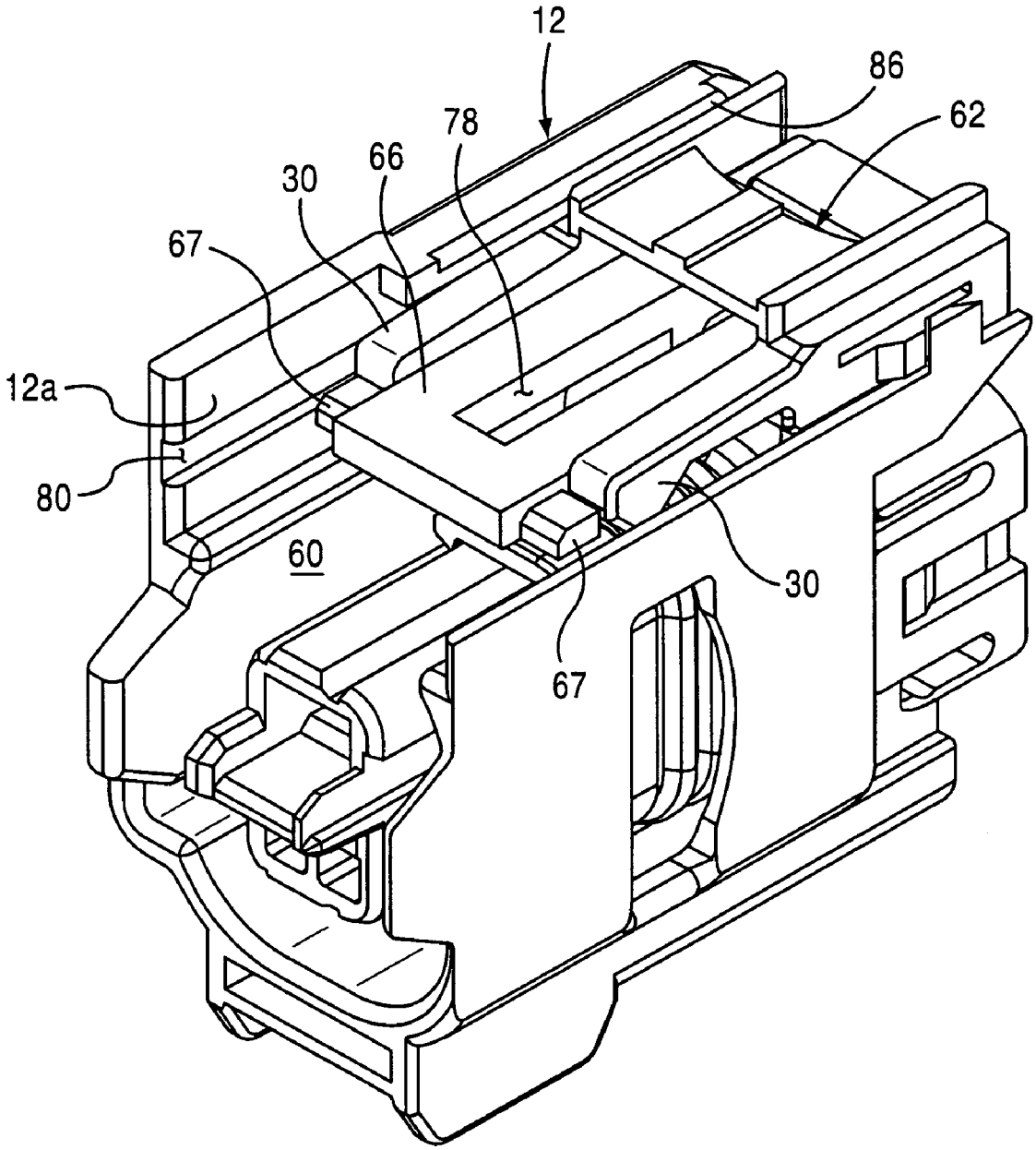
FIG. 8 is a partial perspective view partially in cross-section of a top portion of the first connector member with partial perspective view partially in cross-section of the connector position assurance device of the present invention slidably connected to the first connector member in the disengaged position.

The connector assembly 100 of the present invention is hereinafter described with reference to FIGS. 1, 2 and 7-16. In FIGS. 1, 2 and 7, the first connector member 12 defines a first connector cavity 60 and includes a latch structure 62 and a first connector terminal housing 64, both of which are disposed within the first connector cavity 60 and connected to the first connector member 12. As best shown in FIGS. 7 and 8, the latch structure 62 includes a latch 66 and a pair of stops 67. Each stop 67 is connected to and extends laterally from the latch 66. As best shown in FIG. 7, the latch 66 is movable to and between a normal relaxed state (as illustrated in the solid lines) and a flexed state (phantomly drawn in the dashed lines). The latch 66 is resiliently biased to the normal relaxed state.

Figure 9:
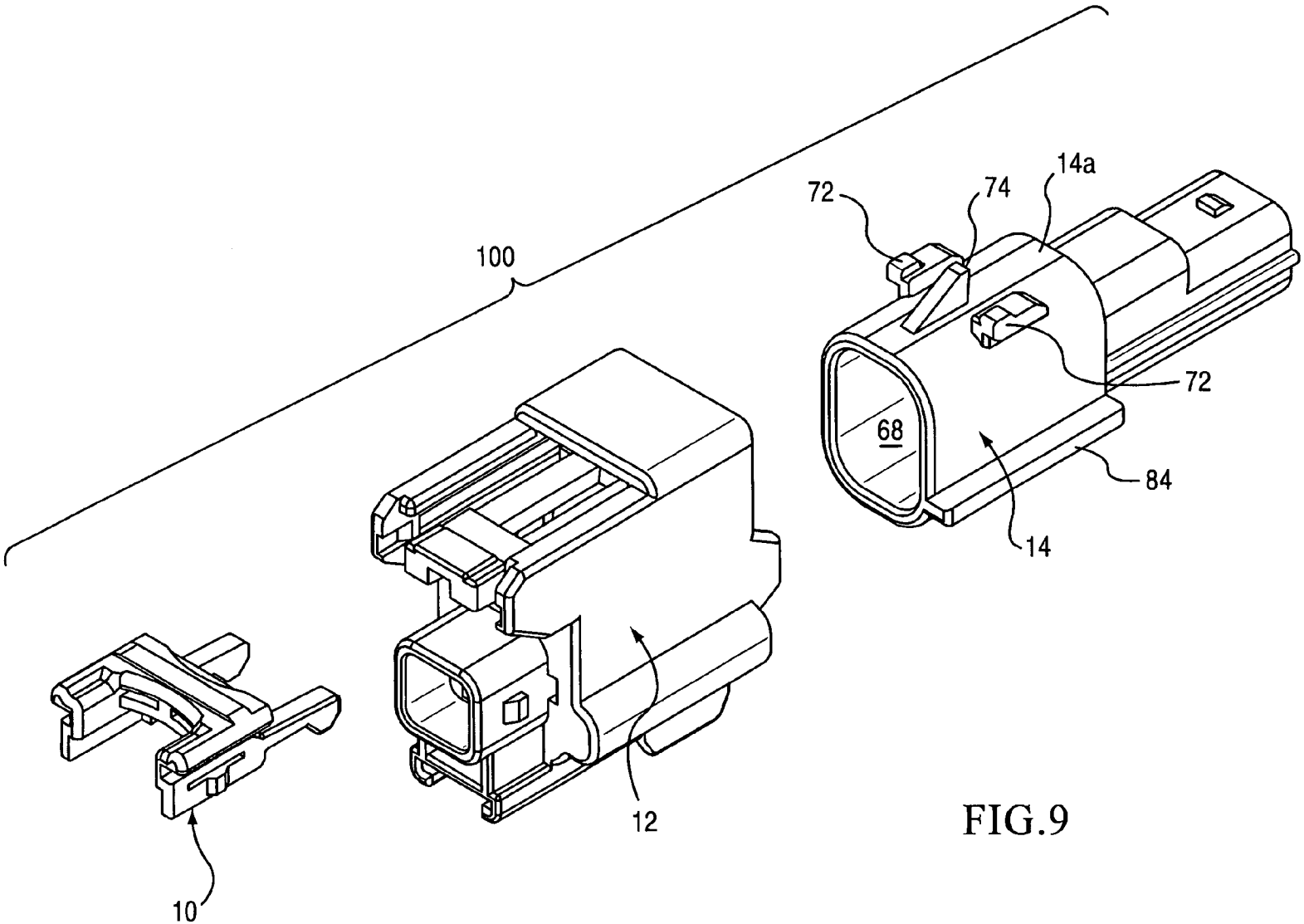
FIG. 9 is exploded reverse perspective view of the connector assembly shown in FIG. 1.
Figure 10:
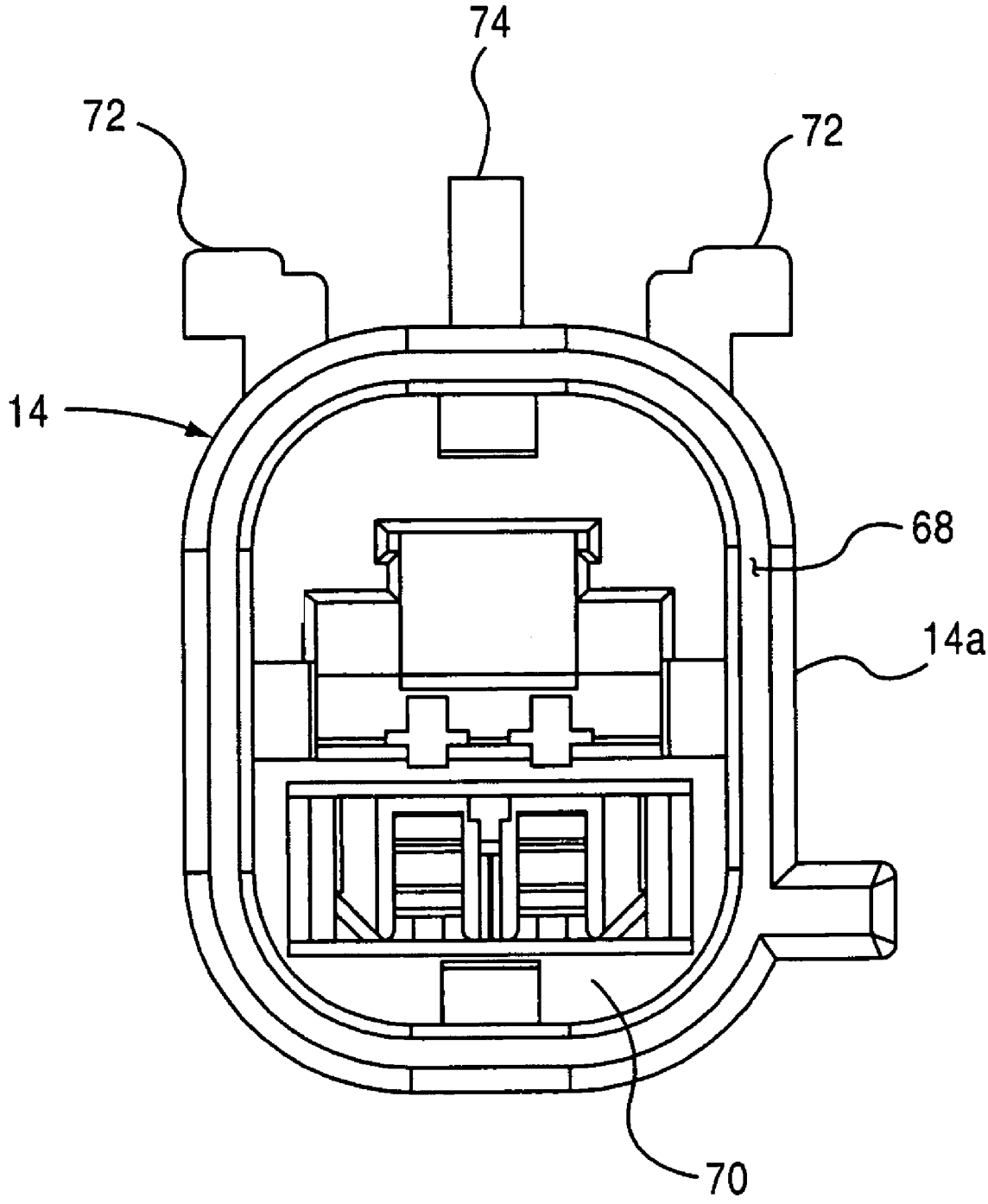
FIG. 10 is a front elevational view of the second connector member.

As illustrated in FIGS. 7 and 9, the second connector member 14 is sized and adapted to be received by the first connector cavity 60 and defines a second connector cavity 68. The second connector cavity 68 is sized and adapted to receive the first connector terminal housing 64 as best shown in FIGS. 11-14 as described below. The second connector member 14 has a second connector terminal housing 70 as best shown in FIGS. 7 and 10. The second connector terminal housing 70 is disposed within the second connector cavity 68 and is connected to the second connector member 14. As best shown in FIG. 10, the second connector member 14 having a second connector exterior surface 14*a* with a pair of catches 72 and a locking ramp 74 that is disposed between the pair of catches 72. The locking ramp 74 as a locking ramp surface 74*a* that generally faces the first connector cavity 60 as shown in FIGS. 1, 2 and 7 when the first connector member 12 and the second connector member 14 are to be connected together as discussed in more detail below. The pair of catches 72 and the locking ramp 74 project from the second connector exterior surface 14*a*.

Figure 16:
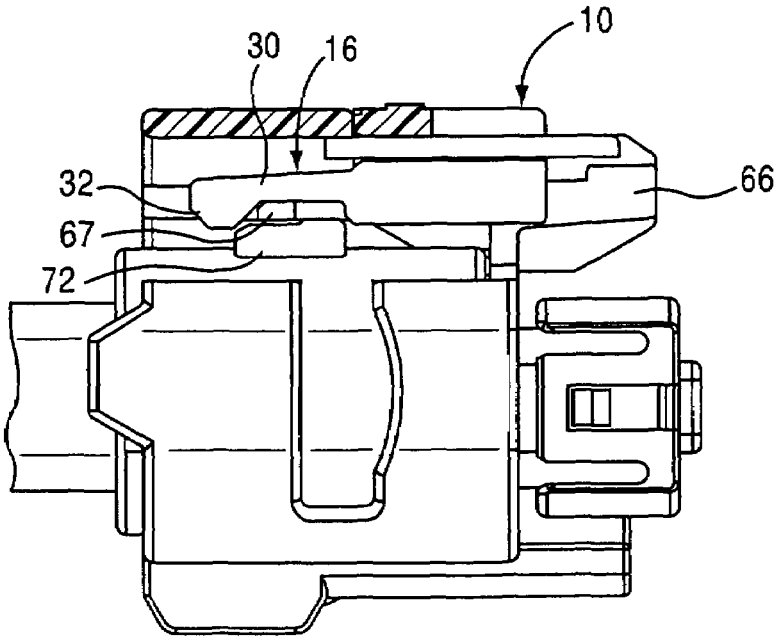

With reference to FIGS. 2 and 9, the connector position assurance device 10 is slidably connected to the first connector member 12 for movement from a disengaged position (see FIGS. 2 and 11-14) to an engaged position (see FIG. 16). With reference to FIG. 7, the forward end portions 30 of each locking arm member 16 are movable upwardly and downwardly relative to the rear end portions. Each forward end portion 30 is operative, as described in more detail below, progressively to and between an normal relax condition NRC (drawn in solid lines), an intermediate flexed condition IFC (drawn in phantom lines) and an extended flexed condition EFC (drawn in phantom lines). The forward end portions 30 are resiliently biased to the normal relaxed condition NRC.

As best shown in FIG. 7, the latch structure 62 is pivotably mounted to the first connector terminal housing 64. The latch structure 62 includes a fulcrum piece 76 with the latch 66 mounted to the fulcrum piece in a see-saw manner. Also, as best shown in FIG. 8, the latch 66 has a locking ramp-receiving hole 78 that is sized to receive the locking ramp 74 when the first and second connector members are connected together.

With reference to FIG. 8, the first connector member 12 has a first connector interior surface 12*a* that defines the first connector cavity 60. The first connector member 12 includes a pair of guide-receiving channels 80 that are formed into the first connector interior surface 12*a*. The pair of guide-receiving channels 80 are disposed opposite one another and adjacent the latch structure 62. Respective ones of the pair of guide-receiving channels 80 are arranged to slidably receive respective ones of the guide elements 20 so that the connector position assurance device 10 can slide relative to the first connector member 12.

Additionally, as shown in FIGS. 1 and 2, the first connector member 12 includes a guide-rail channel formed into the first connector interior surface 12*a*. As the shown in FIGS. 1, 2 and 9, the second connector member 14 includes a guide rail 84 that is sized and adapted to be slidably received by the guide-rail channel 82 of the first connector member 12. Also, As best shown in FIGS. 1, 2 and 8, the first connector member 12 includes a pair of first connector guide rails 86 that are disposed above the latch structure 62. Respective ones of the pair of first connector guide rails 86 are sized and adapted to be slidably received by respective ones of the cross member guide channels 55 formed into the connector position assurance device 10 as described above.

The operation of the connector assembly 100 is hereinafter described primarily with reference to FIGS. 11-16.

Figure 11:
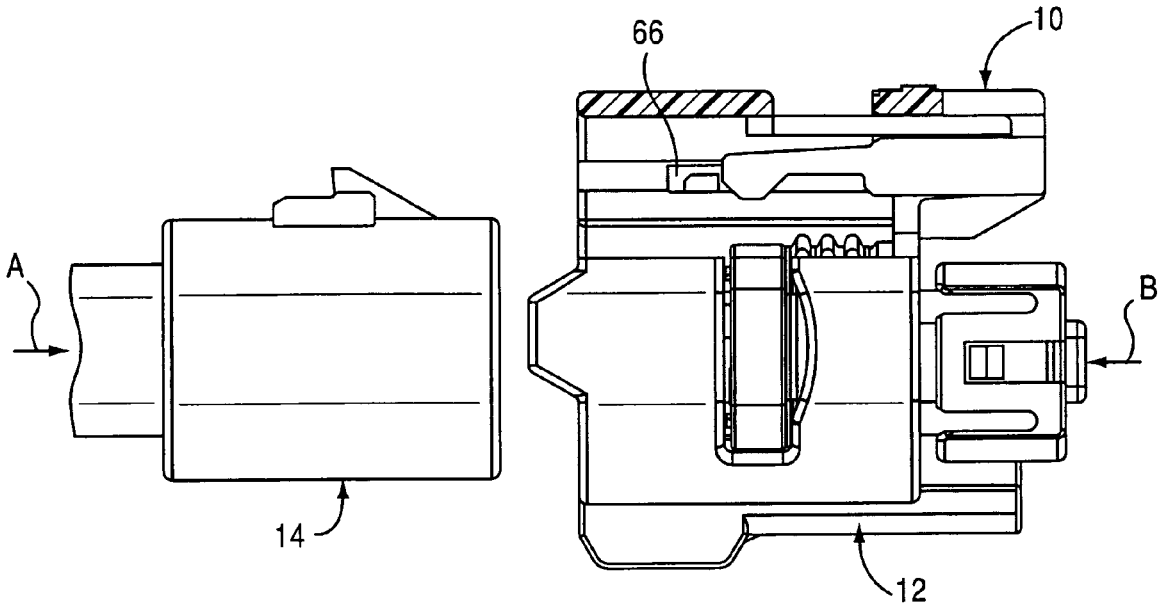
FIGS. 11-16 are side elevational views of the first connector member, the second connector member and a connector position assurance device of the present invention that illustrate in sequence the operation of the connector assembly and how the first connector member, the second connector member and the connector position assurance device function relative to each other when the first and second connector members are being connected to each other.
Figure 12:
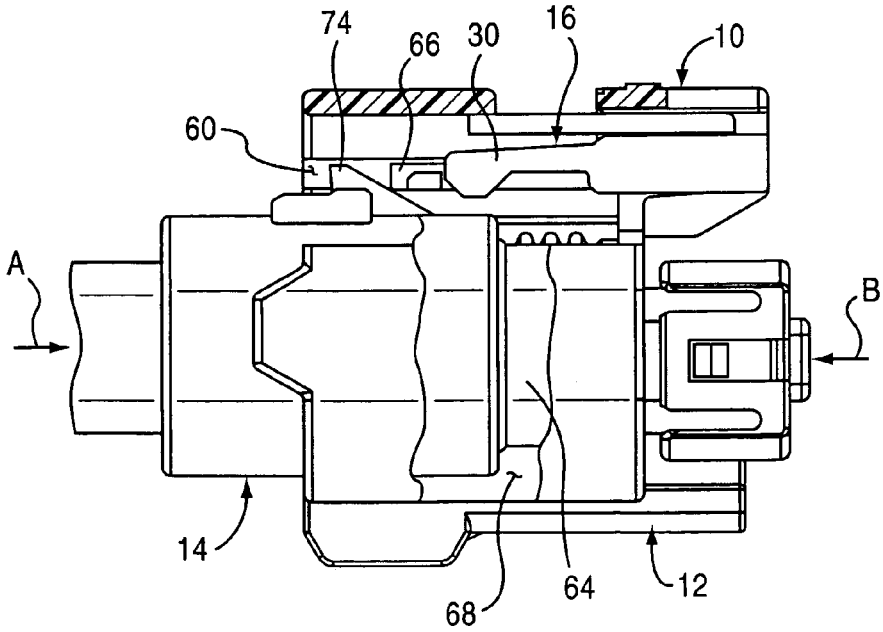

Prior to completely connecting the first and second connector members together as shown in FIGS. 11 and 12 with the connector position assurance device 10 in the disengaged position and the latch 66 in the normal relaxed state, the latch 66 is in a movement prevention condition as best shown in FIG. 8. In the movement prevention condition, the latch 66 prevents slidable movement of the connector position assurance device 10 relative to the first connector member 12 as a result of respective ones of the pair of stops 67 and the forward end portions 30 of the locking our members 16 being at least partially facially opposed to one another as illustrated in FIG. 8. Before moving the connector position assurance device 12 from the disengaged position (as shown in FIGS. 11-14) to the engaged position (FIG. 16), the first and second connector members 12 and 14 respectively are connected by being moved together relative to each other as reflected by arrows A and B in FIGS. 11-13. A skilled artisan would appreciate that the first and second connector members 12 and 14 are connected together progressively from a first insertion position shown in FIG. 12, a second insertion position shown in FIG. 13 and a third insertion position shown in FIG. 14.

In the first insertion position shown in FIG. 12, the first connector cavity 60 receives the second connector member while the second connector cavity 68 receives the first connector terminal housing 64 and, with the connector position assurance device 10 being in the disengaged position, the locking ramp 74 contacts the latch 66 while the forward end portions 30 of the locking arm members 16 are in the normal relaxed condition.

Figure 13:
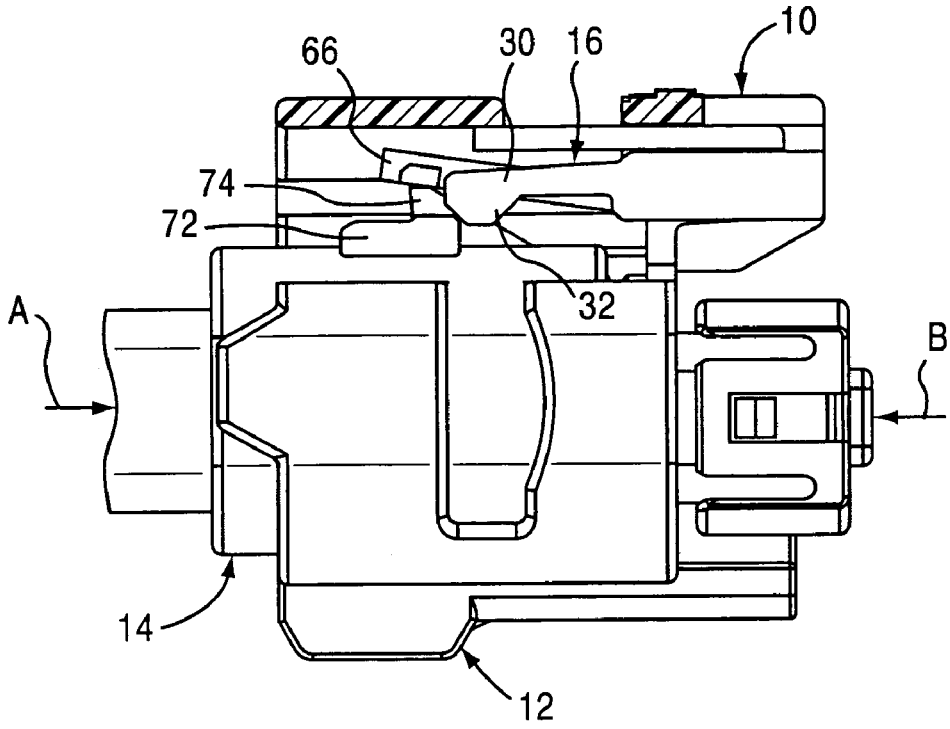

With reference to FIGS. 12 and 13, as the first and second connector members 12 and 14 move from the first insertion position to the second insertion position, the locking ramp 74 moves the latch 66 upwardly from the normal relaxed state (FIG. 12) to the intermediate flexed state (FIG. 13) thereby releasing the latch 66 from the movement prevention condition (FIG. 12) in order to permit slidable movement of the connector position assurance device 10 while the forward end portions 30 of the locking arm members 16 remain in the normal relaxed condition (FIG. 13).

Figure 14:
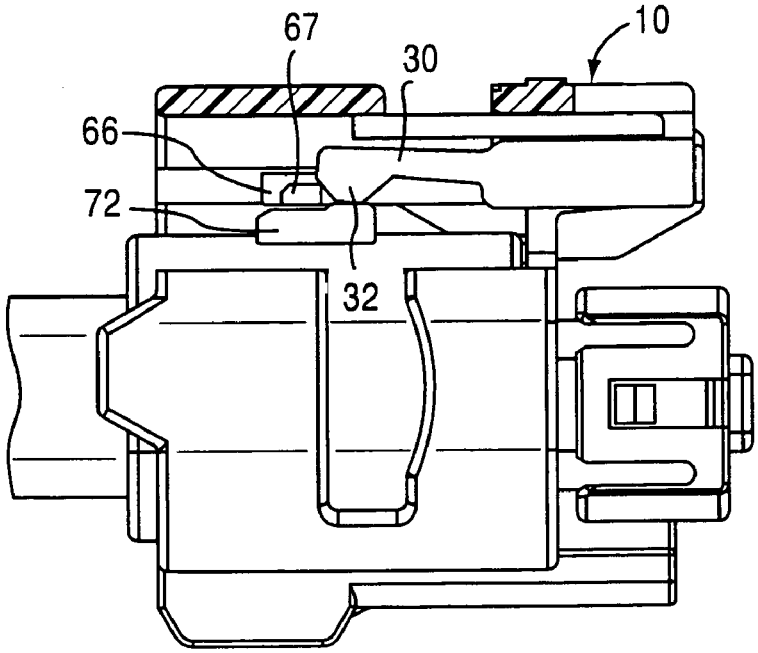

As the first and second connectors move from the second insertion position (FIG. 13) to the third insertion position (FIG. 14) as illustrated sequentially in FIGS. 13 and 14, the latch 66 moves downwardly from the flexed state (FIG. 13) to the normal relaxed state (FIG. 14) to capture the locking ramp 74 in the locking ramp-receiving hole 78 thereby locking the first and second connector members 12 and 14 together in a primary locked state (FIG. 14). Note as shown in FIG. 14 that respective ones of the locking projections 32 and the catches 72 slidably contact each other and the forward end portions 30 move from the normal relax condition (FIG. 13) to the intermediate flexed condition (FIG. 14) and the locking projections 32 are disposed on top of the catches 72.

In the third insertion position shown in FIG. 14, the connector position assurance device 10 is now operative to slidably move from the disengaged position (for example as shown in FIG. 14) to the engaged position (shown in FIG. 16). Note that the forward end portions 30 move from the intermediate 9' flexed condition (FIG. 14) to the extended flexed condition (FIG. 15) as the respective locking projections 32 slide onto the respective stops 67 (FIG. 14 to FIG. 15).

Figure 15:
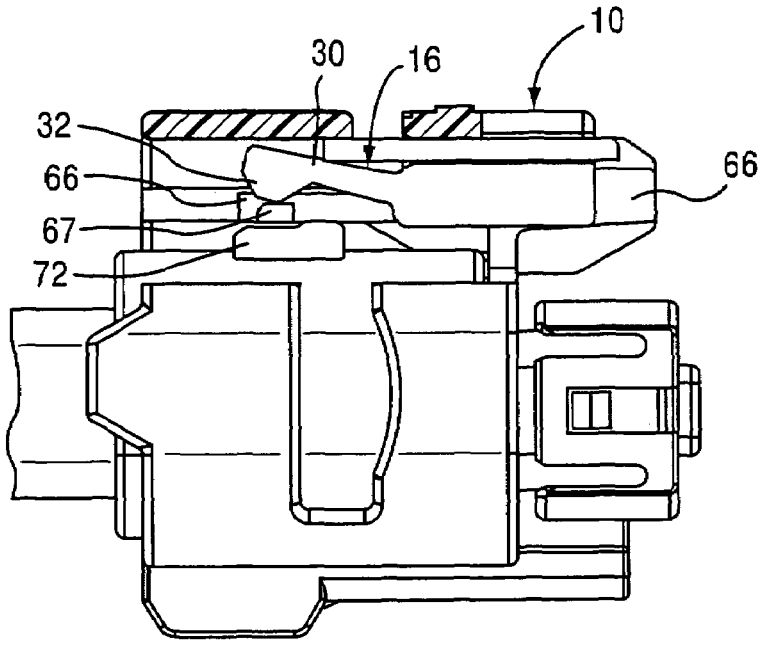

As the connector position assurance device 12 moves from the disengaged position to the engaged position as shown sequentially in FIGS. 14-16, the forward end portions 30 in the extended flexed condition (FIG. 15) slidably moves over the stops 67. When the connector position assurance device 10 arrives at the engaged position (FIG. 16), the forward end portions 30 move from the extended flexed condition (FIG. 15) to the normal relaxed condition (FIG. 16) and the locking projections 32 are now disposed at least substantially forward of the catches 72 and the stops 67 thereby providing a secondary locked state (FIG. 16) along with the primary locked state for the first and second connector members now 12 and 14 considered to be completely connected together, i.e. locked in both the primary and secondary locked states.

A skilled artisan would appreciate that the connector position assurance device 12 is not permanently stressed when in the engaged position with the first and second connector members but, in practice, is in normal relaxed condition. Also, when the connector position assurance device is in the engaged position, a rear portion of the latch 66 as best shown in FIG. 16 is exposed to the user. Since the latch 66 is mounted to the fulcrum piece 76 in a see-saw manner, the latch can be directly depressed by a user to release the connector position assurance device 12 from engagement with the first and second connector members.

The present invention, may, however, be embodied in various different forms and should not be construed as limited to the exemplary embodiments set forth herein; rather, these exemplary embodiments are provided so that this disclosure will be thorough and complete and will fully convey the scope of the present invention to those skilled in the art.

What is claimed is:

1. A connector position assurance device, comprising:

a pair of locking arm members disposed apart from one another in a generally parallel manner, each locking arm member having a top surface, a bottom surface extending parallel to the top surface, an outwardly-facing side surface extending perpendicularly to and between the top and bottom surfaces, a rear end portion and a forward end portion integrally connected to and disposed opposite the rear end portion, each forward end portion having a locking projection depending from the bottom surface;

a cross member integrally connected to the pair of locking arm members on the respective top surfaces at the rear end portions; and a pair of guide elements, each guide element integrally connected to and projecting outwardly from a respective one of the outwardly-facing side surfaces at the rear end portions.

2. A connector position assurance device according to claim 1, wherein each forward end portion has a generally flat front surface extending between the top surface and the locking projection.

3. A connector position assurance device according to claim 2, wherein each locking arm member includes a top curved edge interconnecting the top surface and the generally flat front surface and a bottom curved edge interconnecting the locking projection and the generally flat front surface.

4. A connector position assurance device according to claim 3, wherein each locking projection is configured as a trapezoid shape with a first tapered surface connecting the bottom curved edge and tapering downwardly and rearwardly from the bottom curved edge towards the rear end portion, a flat bottom locking projection surface extending generally parallel with the top surface and a second tapered surface connecting the flat bottom locking projection surface and tapering upwardly and rearwardly from the flat bottom locking projection surface to the bottom surface of the locking arm member.

5. A connector position assurance device according to claim 1, wherein respective ones of the forward end portions are integrally formed with respective ones of the rear end portions in a cantilevered manner.

6. A connector position assurance device according to claim 1, wherein each one of the guide elements has a guide element flat surface, a first guide element tapered surface and a second guide element tapered surface, each first guide element tapered surface tapering forwardly from the guide element flat surface to the outwardly-facing side surface of the rear end portion, each second guide tapered surface tapering rearwardly from the guide element flat surface to the outwardly-facing side surface of the rear end portion.

7. A connector position assurance device according to claim 1, wherein the cross member includes a top panel and a pair of side panels, respective side panels are disposed between and integrally connecting the top panel and the rear end portion at the top surface to define a pair of cross member guide channels extending parallel with the pair of locking arm members.

8. A connector position assurance device according to claim 7, wherein the cross member includes a bottom panel disposed apart from and extending parallel with the top panel and between the pair of side panels, the bottom panel being integrally connected to and between the pair of side panels.

9. A connector position assurance device according to claim 7, wherein the cross member includes a rib disposed between and integrally connecting the top and bottom panels, the rib is disposed generally centrally between the pair of side panels and extends parallel with the pair of locking arm members.

10. A connector position assurance device according to claim 7, wherein the top panel extends outwardly relative to respective ones of the rear end portions of the locking arm members.

11. A connector position assurance device according to claim 7, wherein the top panel extends outwardly relative to respective ones of the pair of guide elements.

12. A connector assembly, comprising:

a first connector member defining a first connector cavity and including a latch structure and a first connector terminal housing disposed within the first connector cavity and connected to the first connector member, the latch structure including a latch and a pair of stops, the latch being movable to and between a normal relaxed state and a flexed state, the latch being resiliently biased to the normal relaxed state, each stop being connected to and extending laterally from the latch;

a second connector member sized and adapted to be received by the first connector cavity and defining a second connector cavity sized and adapted to receive the first connector terminal housing, the second connector member having a second connector terminal housing disposed within the second connector cavity and connected to the second connector member, the second connector member having a second connector exterior surface with a pair of catches and a locking ramp disposed between the pair of catches, the pair of catches and the locking ramp projecting from the second connector exterior surface; and a connector position assurance device slidably connected to the first connector member for movement from a disengaged position to an engaged position, the connector position assurance device having a pair of locking arm members disposed apart from one another in a generally parallel manner and a cross member integrally connected to the pair of locking arm members, each locking arm member having a rear end portion and a forward end portion integrally connected to and disposed opposite the rear end portion with each forward end portion having a locking projection depending therefrom, the forward end portions movable upwardly and downwardly relative to the rear end portions and progressively to and between an normal relax condition, an intermediate flexed condition and an extended flexed condition, the forward end portions being resiliently biased to the normal relaxed condition, wherein, prior to completely connecting the first and second connector members together with the connector position assurance device in the disengaged position and the latch in the normal relaxed state, the latch in a movement prevention condition prevents slidable movement of the connector position assurance device relative to the first connector member as a result of respective ones of the pair of stops and the forward end portions being at least partially facially opposed to one another, before moving the connector position assurance device from the disengaged position to the engaged position, the first and second connector members are connected by being moved together relative to each other progressively from a first insertion position, a second insertion position and a third insertion position, such that, in the first insertion position, the first connector cavity receives the second connector member while the second connector cavity receives the first connector terminal housing and, with the connector position assurance device being in the disengaged position, the locking ramp contacts the latch while the forward end portions of the locking arm members are in the normal relaxed condition, as the first and second connector members move from the first insertion position to the second insertion position, the locking ramp moves the latch upwardly from the normal relaxed state to the intermediate flexed state thereby releasing the latch from the movement prevention condition in order to permit slidable movement of the connector position assurance device while the forward end portions of the locking arm members remain in the normal relaxed condition, as the first and second connectors move from the second insertion position to the third insertion position, the latch moves downwardly from the flexed state to the normal relaxed state to capture the locking ramp thereby locking the first and second connector members together in a primary locked state and respective ones of the locking projections and the catches slidably contact each other and the forward end portions move from the normal relax condition to the intermediate flexed condition, the locking projections being disposed on top of the catches, in the third insertion position, the connector position assurance device is operative to slidably move from the disengaged position to the engaged position such that the forward end portions move from the intermediate flexed condition to the extended flexed condition as the respective locking projections slide onto the respective stops, as the connector position assurance device moves from the disengaged position to the engaged position, the forward end portions in the extended flexed condition slidably moves over the stops, when the connector position assurance device arrives at the engaged position, the forward end portions move from the extended flexed condition to the normal relaxed condition with the locking projections being disposed at least substantially forward of the catches and the stops thereby providing a secondary locked state for the first and second connector members now completely connected together.

13. A connector assembly according to claim 12, wherein the latch structure is pivotably mounted to the first connector terminal housing.

14. A connector assembly according to claim 13, wherein the latch structure includes a fulcrum piece with the latch mounted to the fulcrum piece in a see-saw manner.

15. A connector assembly according to claim 12, wherein the latch has a locking ramp-receiving hole sized to receive the locking ramp when the first and second connector members are in the third insertion position.

16. A connector assembly according to claim 12, wherein the first connector member has a first connector interior surface defining the first connector cavity, the first connector member including a pair of guide-receiving channels formed into the first connector interior surface, the pair of guide-receiving channels being disposed opposite one another and adjacent the latch structure.

17. A connector assembly according to claim 16, wherein the first connector member includes a guide-rail channel formed into the first connector interior surface.

18. A connector assembly according to claim 17, wherein the second connector member includes a guide rail sized and adapted to be slidably received by the guide-rail channel of the first connector member.

19. A connector assembly according to claim 12, wherein each locking arm member has a top surface, a bottom surface and an outwardly-facing side surface extending between the top and bottom surfaces, the locking projection depending from the bottom surface, the cross member being integrally connected to the pair of locking arm members on the respective top surfaces at the rear end portions.

20. A connector assembly according to claim 12, wherein the connector position assurance device including a pair of guide elements, each guide element being integrally connected to and projecting outwardly from a respective one of the outwardly-facing side surfaces at the rear end portions.

21. A connector assembly according to claim 20, each one of the guide elements has a guide element flat surface, a first guide element tapered surface and a second guide element tapered surface, each first guide element tapered surface tapering forwardly from the guide element flat surface to the outwardly-facing side surface of the rear end portion, each second guide tapered surface tapering rearwardly from the guide element flat surface to the outwardly-facing side surface of the rear end portion.

22. A connector assembly according to claim 20, wherein each forward end has a generally flat front surface extending between the top surface and the locking projection.

23. A connector assembly according to claim 22, wherein each locking arm member includes a top curved edge interconnecting the top surface and the generally flat front surface and a bottom curved edge interconnecting the locking projection and the generally flat front surface.

24. A connector assembly according to claim 23, wherein each locking projection is configured as a trapezoid shape with a first tapered surface connecting the bottom curved edge and tapering downwardly and rearwardly from the bottom curved edge towards the rear end portion, a flat bottom locking projection surface extending generally parallel with the top surface and a second tapered surface connecting the flat bottom locking projection surface and tapering upwardly and rearwardly from the flat bottom locking projection surface to the bottom surface of the locking arm member.

25. A connector assembly according to claim 12, wherein respective ones of the forward end portions are integrally formed with respective ones of the rear end portions in a cantilevered manner.

26. A connector assembly according to claim 12, wherein the cross member includes a top panel and a pair of side panels, respective side panels are disposed between and integrally connecting the top panel and the rear end portion at the top surface to define a pair of cross member guide channels extending parallel with the pair of locking arm members.

27. A connector assembly according to claim 26, wherein the cross member includes a bottom panel disposed apart from and extending parallel with the top panel and between the pair of side panels, the bottom panel being integrally connected to and between the pair of side panels.

28. A connector assembly according to claim 26, wherein the cross member includes a rib disposed between and integrally connecting the top and bottom panels, the rib is disposed generally centrally between the pair of side panels and extends parallel with the pair of locking arm members.

29. A connector assembly according to claim 26, wherein the top panel extends outwardly relative to respective ones of the rear end portions of the locking arm members.

30. A connector assembly according to claim 26, wherein the top panel extends outwardly relative to respective ones of the pair of guide elements.

31. A connector assembly according to claim 26, wherein the first connector member includes a pair of first connector guide rails disposed above the latch structure, respective ones of the pair of first connector guide rails sized and adapted to be slidably received by respective ones of the cross member guide channels.

32. A connector position assurance device, comprising:

a connector position assurance device body member extending along and about a length-wise axis in a length-wise direction, a width-wise axis in a with-wise direction and a height-wise axis in a height-wise direction, the length-wise axis, the width-wise axis and the height-wise axis oriented perpendicularly to one another with the length-wise axis and the width-wise axis forming a length-width plane, the height-wise axis and the length-wise axis forming a height-length plane and the height-wise axis and the width-wise axis forming a height-width plane, the connector position assurance device body member including a pair of locking arm members and a cross member, wherein the pair of locking arm members extend primarily in the length-wise direction and are disposed apart from one another in the width-wise direction in a parallel relationship, each locking arm member having a top surface, a bottom surface, an outwardly-facing side surface, a rear end portion and a forward end portion disposed opposite the rear end portion, the top surface extends parallel to the length-width plane, the bottom surface extends parallel to the top surface and the length-width plane, the outwardly-facing side surface extends parallel to the height-length plane and perpendicularly to and between the top and bottom surfaces, the rear end portion and the forward end portion are integrally connected to each other, each forward end portion has a locking projection depending from the bottom surface in the height-wise direction, and the cross member is integrally connected to the pair of locking arm members on the respective top surfaces at the rear end portions.

33. A connector assembly according to claim 32, wherein connector position assurance device body member includes a pair of guide elements, each guide element integrally connected to and projecting outwardly from a respective one of the outwardly-facing side surfaces at the rear end portions.

34. A connector assembly according to claim 32, wherein each one of the forward end portions is movable upwardly and downwardly relative to the rear end portions in the height-wise direction to and between an normal relax condition and a flexed condition while the pair of locking arm members remain in the parallel relationship, each one of the forward end portions is resiliently biased in the normal relaxed condition.

* * * * *